US007584833B2

(12) United States Patent
Howells

(10) Patent No.: US 7,584,833 B2
(45) Date of Patent: Sep. 8, 2009

(54) COIN DISCRIMINATORS

(75) Inventor: Geoffrey Howells, Salisbury (GB)

(73) Assignee: ScanCoin Industries AB, Malmo (SE)

( * ) Notice: Subject to any disclaimer, the term of this patent is extended or adjusted under 35 U.S.C. 154(b) by 181 days.

(21) Appl. No.: 10/962,297

(22) Filed: Oct. 8, 2004

(65) Prior Publication Data

US 2006/0151284 A1 Jul. 13, 2006

Related U.S. Application Data

(63) Continuation of application No. 10/948,708, filed on Sep. 23, 2004, now abandoned.

(60) Provisional application No. 60/553,149, filed on Mar. 15, 2004, provisional application No. 60/553,220, filed on Mar. 15, 2004.

(51) Int. Cl.
*G07D 5/08* (2006.01)

(52) U.S. Cl. ..... 194/317; 194/302; 194/303; 194/328

(58) Field of Classification Search ..... 73/514.14; 702/38, 85–107; 194/302–304, 317–320, 194/328–330
See application file for complete search history.

(56) References Cited

U.S. PATENT DOCUMENTS

| | | | | |
|---|---|---|---|---|
| 3,599,771 | A | 8/1971 | Hinterstocker | |
| 3,788,440 | A | 1/1974 | Propice et al. | |
| 4,184,366 | A | 1/1980 | Butler | |
| 4,360,034 | A | 11/1982 | Davila et al. | |
| 4,361,218 | A * | 11/1982 | Van Dort | 194/317 |
| 4,460,080 | A | 7/1984 | Howard | |
| 4,471,864 | A | 9/1984 | Marshall | |
| 4,556,140 | A | 12/1985 | Okada | |
| 4,717,006 | A | 1/1988 | Chapman et al. | |
| 4,754,862 | A | 7/1988 | Rawicz-Szczerbo et al. | |
| 4,951,800 | A | 8/1990 | Yoshihara | |
| 4,971,187 | A | 11/1990 | Furuya et al. | |
| 5,067,604 | A | 11/1991 | Metcalf | |
| 5,240,099 | A | 8/1993 | Brown et al. | |
| 5,316,120 | A | 5/1994 | Ibarrola | |
| 5,458,225 | A | 10/1995 | Iwamoto et al. | |

(Continued)

FOREIGN PATENT DOCUMENTS

| | | |
|---|---|---|
| EP | 0 119 000 | 4/1989 |

(Continued)

OTHER PUBLICATIONS

Scan Coin Technical Manual CDS MK 1 Coin Deposit System, 1991, Table of Contents and pp. 13-23.

(Continued)

*Primary Examiner*—Jeffrey A Shapiro
(74) *Attorney, Agent, or Firm*—Womble Carlyle Sandridge & Rice, PLLC

(57) ABSTRACT

A coin discriminator measures both the surface and average electrical conductivity of coins in order to distinguish genuine minted coins from fake or bogus coins such as cast coins which may be nominally of the same material as a minted coin. The conductivities are measured using a coil to induce eddy currents within the coin. The high frequency components of the eddy current are monitored to measure the surface conductivity. The low frequency components are measured to monitor the bulk or average conductivity.

8 Claims, 6 Drawing Sheets

Continuous wave embodiment of the invention

U.S. PATENT DOCUMENTS

| | | | | |
|---|---|---|---|---|
| 5,662,205 | A | 9/1997 | Levasseur | |
| 5,687,829 | A | 11/1997 | Churchman | |
| 5,915,518 | A * | 6/1999 | Hopwood et al. | 194/207 |
| 5,988,348 | A | 11/1999 | Martin et al. | |
| 6,039,643 | A | 3/2000 | Kurosawa et al. | |
| 6,047,808 | A | 4/2000 | Neurbarth et al. | |
| 6,056,104 | A | 5/2000 | Neurbarth et al. | |
| 6,196,371 | B1 | 3/2001 | Martin et al. | |
| 6,227,343 | B1 | 5/2001 | Neathway et al. | |
| 6,325,197 | B1 | 12/2001 | Furuya | |
| 6,340,082 | B1 | 1/2002 | House et al. | |
| 6,398,001 | B1 | 6/2002 | Hutchinson et al. | |
| 6,471,030 | B1 | 10/2002 | Neubarth et al. | |
| 6,520,308 | B1 * | 2/2003 | Martin et al. | 194/317 |
| 6,988,606 | B2 | 1/2006 | Geib et al. | |

FOREIGN PATENT DOCUMENTS

| | | | |
|---|---|---|---|
| EP | 0119000 | | 4/1989 |
| EP | 0 343 871 | A2 | 11/1989 |
| EP | 0 349 114 | A2 | 1/1990 |
| EP | 0 364 079 | | 4/1990 |
| EP | 0 841 641 | A2 | 5/1998 |
| EP | 1 020 818 | A1 | 7/2000 |
| EP | 1104920 | | 6/2001 |
| EP | 0724237 | | 4/2002 |
| GB | 2135095 | | 8/1984 |
| GB | 2 160 689 | | 12/1985 |
| GB | 2 243 238 | A | 10/1991 |
| GB | 2 301 925 | A | 12/1996 |
| GB | 2 323 200 | | 9/1998 |
| GB | 2323199 | | 9/1998 |
| GB | 2357883 | | 7/2001 |
| GB | 2358272 | | 7/2001 |
| SE | 512200 | | 2/2000 |
| WO | WO 87/07742 | | 12/1987 |
| WO | WO 97/07485 | | 2/1997 |
| WO | WO 97/25692 | | 7/1997 |
| WO | WO 00/25274 | | 5/2000 |
| WO | WO 01/29785 | | 4/2001 |

OTHER PUBLICATIONS

Preliminary Amendment dated May 4, 2004, for co-pending U.S. Appl. No. 10/494,599.

Office Action dated Jun. 2, 2006, for co-pending U.S. Appl. No. 10/494,599.

Amendment A dated Sep. 1, 2006, for co-pending U.S. Appl. No. 10/494,599.

Office Action dated Nov. 9, 2006, for co-pending U.S. Appl. No. 10/494,599.

Amendment B dated Feb. 16, 2007, for co-pending U.S. Appl. No. 10/494,599.

Office Action dated Apr. 27, 2007, for co-pending U.S. Appl. No. 10/494,599.

Amendment C dated Aug. 21, 2007, for co-pending U.S. Appl. No. 10/494,599.

Office Action dated Oct. 26, 2007, for co-pending U.S. Appl. No. 10/494,599.

Response to Office Action dated Jan. 24, 2008, for co-pending U.S. Appl. No. 10/494,599.

* cited by examiner

The magnetic field within a coin due to a coil

The effect of frequency and conductivity on skin depth.

Genuine coin conductivities

Comparison with counterfeit coins

Effect of coin range on apparent coil inductance and resistance.

Continuous wave embodiment of the invention

Pulse induction, PI, embodiment of the invention

Advantages of the PI embodiment

COIN DISCRIMINATORS

CROSS-REFERENCE TO RELATED APPLICATIONS

This application is a continuation of application Ser. No. 10/948,708, filed on Sep. 23, 2004; now abandoned which application claims the benefit of provisional application No. 60/553,149, filed Mar. 15, 2004, and provisional application No. 60/553,220, filed Mar. 15, 2004, and which application also claims priority to British application no. GB0322354.2, filed Sep. 24, 2003, and British application no. GB0405616.4, filed Mar. 12, 2004.

INCORPORATION BY REFERENCE

The specification of U.S. application Ser. No. 10/948,708, filed on Sep. 23, 2004; provisional application No. 60/553,149, filed Mar. 15, 2004; provisional application No. 60/553,220, filed Mar. 15, 2004; British application no. GB0322354.2, filed Sep. 24, 2003; and British application no. GB0405616.4, filed Mar. 12, 2004 are incorporated herein in their entirety, by this reference.

TECHNICAL FIELD

The present invention relates to a coin discriminator and to a method of discriminating between genuine coins and some fake or bogus coins.

The present invention is particularly concerned with a coin discriminator which measures both the surface and average electrical conductivity of the coin. In brief, the conductivities are measured by means of a coil inducing eddy currents within the coin. The high frequency components of the eddy current measure the surface conductivity. The low frequency components measure the bulk or average conductivity. The eddy currents induced in the metal coin are measured by a detection means external of the coin. The measured values are compared to the values from known genuine coins and suspect coins are rejected.

DESCRIPTION OF THE PRIOR ART

Coin discriminators are used for measuring different physical characteristics of a coin in order to determine its type, eg its denomination, currency or authenticity. Various dimensional, electric and magnetic characteristics are measured for this purpose, such as the diameter and thickness of the coin, its electric conductivity, its magnetic permeability, and its surface and/or edge pattern, eg its edge knurling. Coin discriminators are commonly used in coin handling machines, such as coin counting machines, coin sorting machines, vending machines, gaming machines, etc. Examples of previously known coin handling machines are for instance disclosed in WO 97/07485 and WO 87/07742.

Prior art coin discriminators often employ a small coil with a diameter smaller than the diameter of the coin. The coil arrangement is shown in FIG. 1. This coil is used to measure the conductivity and/or magnetic properties of the coin. The coin rolls, or is driven, past the coil. The measurements used to identify the coin are usually made when the middle of the coin is over the coil. In many applications, measurements are made continuously to determine when the coin is in the correct position for identification.

The coin conductivity measurement results obtained vary depending on the actual spot of measurement on the coin. This may be due to differences in range between the coil and the metal caused by the pattern on the coin, or distortion in the eddy current loop caused by the vicinity of the rim of a coin.

The electronic circuits using a single coil to measure coins can be divided into two types:

1) Continuous wave (CW) techniques that drive the coil with a sine or square wave.
2) Pulse induction (PI) techniques that use a step change in current to produce an exponentially decaying eddy current within the coin.

In the CW technique, if the same coil is used for both generating and sensing the eddy currents, the effect of the coin is to cause an apparent change in the inductance and resistance of the coil. The electronic circuit measures these changes and uses them to identify the type of coin. This is the principle used by coin acceptors in vending machines, gaming machines and coin counting machines.

It will be appreciated by the skilled person that the CW and PI techniques are equivalent when used with non-magnetic coins.

The CW technique can be sub-divided into two types of electronic circuit:

1.1) The frequency shift method is the simplest and cheapest. In this technique, the coil forms part of the frequency determining elements of an oscillator. A change in the inductance of the coil causes a change in oscillator frequency. This frequency shift is used to identify the coin. The limitation of this method is that it does not measure the change in the resistance of the coil, and thus, it only uses half of the available information.

1.2) The phase shift method drives the coil, usually at a fixed frequency, and then measures the amplitude and phase of the coil voltage or current. By measuring both amplitude and phase, the change in inductance and resistance for the coil can be calculated.

The pulse induction (PI) method which measures the resistance or conductivity of a coin by exposing it to a magnetic pulse and detecting the decay of eddy currents induced in the coin is generally known in the technical field. The way in which such coin discriminators operate is described in eg GB-A-2135095, in which a coin testing arrangement comprises a transmitter coil which is pulsed with a rectangular voltage pulse so as to generate a magnetic pulse, which is induced in a passing coin. The eddy currents thus generated in the coin give rise to a magnetic field, which is monitored or detected by a receiver coil. The receiver coil may be a separate coil or may alternatively be constituted by the transmitter coil having two operating modes. By monitoring the initial amplitude and decay rate of the eddy currents induced in the coin, a value representative of the coin conductivity may be obtained, since the rate of decay is a function thereof.

As discussed, for non-magnetic coins, the CW and PI techniques are equivalent. The results from one can be converted into the other by using a mathematical method called the Fourier transform. In this application the prior art is described in terms of the CW method. However the same ideas could be described using the language of the PI technique.

Some existing discriminators allow counterfeit coins that differ in physical size, electrical conductivity or magnetic properties to be rejected. The electrical conductivity measured may either be dependant or independent of coin thickness. This is determined by the frequency used to create the eddy currents and the skin depth effect. The skin depth effect causes high frequency currents to flow only on the surface of a conductor. The relationship between skin depth, frequency and conductivity is shown in FIG. 2.

The conductivity in FIG. 2, is given in terms of the percentage of International Annealed Copper Standard, % IACS. This scale is based on the conductivity of pure copper which has been heat treated by a process called annealing. The annealed pure copper is defined as having a conductivity of 100%. FIG. 2 shows two other conductivities. The gold coloured alloy used to make many coins has a conductivity near 16%. The silver coloured alloy used the British 10 & 50 p is 5% IACS, ie it conducts only 1/20th as well as pure copper.

As a rule of thumb, if a coin thickness is more than 3 or 4 skin depths, the conductivity reading will be independent of thickness. From FIG. 2 we can see that frequencies above 100 kHz will give coin conductivity readings independent of coin thickness. Conversely, if the measurement frequency is below 20 kHz, the coin thickness will have a big effect on the "conductivity" reading.

Prior art exists for using two frequencies to discriminate coins, eg Mars Inc patent (GB 1397083 May 1971). The high frequency measures conductivity while the low frequency measures a combination of conductivity and thickness. In practice products based on this patent use separate coils in different locations for the high and low frequency measurements. This simplifies the design of the electronics.

Prior art also exists for using a very high frequency to measure a thin plating layer on the surface of a coin, eg Coinstar GB 2358272, this specification describing a coin sensor using a frequency of 2 MHz to detect the thin nickel layer covering the copper on the US dime. Thus, such discriminators are capable of distinguishing between genuine plated coins and bogus coins of a similar physical appearance, but which are of a very different material content overall.

SUMMARY OF THE INVENTION

The invention stems from some work aimed at increasing the number of counterfeit coins that are rejected. This work took into account the fact that genuine coins of a particular denomination when minted can have a range of characteristics, so that it is desirable to be able to distinguish between a bogus coin of closely similar material and a range of genuine coins of the particular denomination.

The use of one or more recognition sets of parameters was proposed in GB 2135492A, each recognition set consisting of the highest and lowest values of the characteristic being measured, but this is not generally sufficiently accurate to deal with some bogus coins of a similar metal content.

According to one aspect of the invention we provide a method of distinguishing between minted coins of a predetermined type or types and bogus coins of a similar metal content, such as cast coins, comprising subjecting a coil or coils adjacent to the coin under test to both low and high frequency currents, monitoring the apparent change of impedance of the coil or coils resulting from eddy currents induced in the coin to produce first and second signals representative of changes of said impedance, and comparing sets of said first and second signals for the coin under test with a stored distribution of sets of first and second reference signals for minted coins obtained in a calibration procedure using minted coins, the first reference signal of each set of reference signals corresponding to eddy currents produced in a work-hardened surface skin of such minted coins, and the second reference signal of each set corresponding to eddy currents being produced within the body of the minted coins, the frequency of said low frequency current being chosen such that said second reference signals are substantially not dependent on the thickness of the minted coins of said pre-determined type/s.

The distribution of the sets of reference signals could be stored as a polynomial, if desired, that has been fitted to the measured distribution of sets of measurements of the first and second signals obtained during calibration.

It has been found that for many minted coins there is an approximately linear relationship between the conductivities of the surface skin and the body of minted coins in a batch of minted coins which are nominally the same, and the distribution of the sets of first and second signals for minted coins does not overlap with the distribution of the first and second signals for cast coins. This can enable a preferable procedure wherein said comparison step comprises taking the ratio of said first and second signals, and comparing the computed ratio with a ratio of said first and second reference sets.

According to a second aspect of the invention we provide a method of distinguishing between minted coins of a predetermined type or types and bogus coins of a similar metal content, such as cast coins, comprising subjecting a coil or coils adjacent to the coin under test to both low and high frequency currents, monitoring the apparent change of impedance of the coil or coils resulting from eddy currents induced in the coin to produce first and second signals representative of changes of said impedance, and comparing the ratio of said first and second signals for the coin under test with stored reference sets of said ratio of first and second signals for minted coins, the first reference signal of each set of reference signals corresponding to eddy currents produced in a work-hardened surface skin of such minted coins, and the second reference signal of each set corresponding to eddy currents being produced within the body of the minted coins, the frequency of said low frequency current being chosen such that said second reference signals are substantially not dependent on the thickness of the minted coins of said predetermined type/s.

According to a third aspect of the invention we provide a method of distinguishing between minted coins of a predetermined type or types and bogus coins of a similar metal content, such as cast coins, comprising subjecting a coil positioned adjacent to the coin under test to a low frequency current, and subjecting said coil or another coil positioned adjacent to the coin to a high frequency current, monitoring the eddy currents induced in the coin to produce first and second signals representative of the amplitude and phase of eddy currents induced respectively by said low and high frequency coil currents, and comparing the ratio of said first and second signals for the coin under test with the ratio of stored reference sets of said signals for minted coins, or with a stored distribution of a range of sets of said first and second reference signals obtained in a calibration procedure using minted coins, the first reference values corresponding to the amplitude and phase of eddy currents produced substantially in a work-hardened surface skin of such minted coins, and the second set of reference signals corresponding to the amplitude and phase of eddy currents being produced within the body of the minted coins, the frequency of said low frequency current being chosen such that said second reference signals are substantially not dependent on the thickness of the minted coins of said pre-determined type/s.

According to a fourth aspect of the invention we provide a coin discriminator comprising a coin path for receiving coins under test, at least one coil positioned adjacent to said coin path, a first coil energisation means for subjecting said coil to a first, low frequency current, a second coil energisation means for subjecting said coil, or a further coil positioned adjacent to said path, to a second, high frequency current, first monitoring means for monitoring a first apparent change of impedance of said one coil resulting from eddy currents induced in use within the body of said coin by said first current, and for producing a first signal representative of said first change of impedance, and second monitoring means for monitoring a second apparent change of impedance of said coil or further coil, resulting from eddy currents induced in use in a work-hardened surface skin of a coin by said second current, and for producing a second signal representative of said second change of impedance, and comparison means configured to compare the ratio of said first and second signals produced by a coin with the ratio of stored reference sets of said first and second signals, or to compare the sets of first and second signals with a stored distribution of first and second reference signals obtained in a calibration procedure using minted coins.

According to a fifth aspect of the invention we provide a method of distinguishing between minted coins of a predetermined type or types and bogus coins of a similar metal content, such as cast coins, comprising subjecting a coil or coils adjacent to the coin under test to both short and long drive pulses, monitoring the decay of eddy currents induced in the coin by the pulsing of the coil or coils to produce first and second signals representative respectively of the rate of decay of the eddy currents produced by said first and second pulses, and comparing the ratio of said first and second signals for the coin under test with stored reference sets of said ratio of first and second signals for minted coins, or comparing said sets of first and second signals for the coin under test with a stored distribution of said sets obtained in a calibration procedure using minted coins, the first reference signal of each set of reference signals corresponding to eddy currents produced in a work-hardened surface skin of such minted coins, and the second reference signal of each set corresponding to eddy currents being produced within the body of the minted coins, the pulse length of said long pulse being chosen such that said second reference signals are substantially not dependent on the thickness of the minted coins of said predetermined type/s.

According to a sixth aspect of the invention we provide a coin discriminator comprising a coin path for receiving coins under test, at least one coil positioned adjacent to said coin path, a first coil pulse drive means for subjecting said coil to a first drive pulse of short duration, a second coil pulse drive means for subjecting said coil, or another coil of said at least one coil, to a second drive pulse of longer duration, a first monitoring means adapted to monitor the decay of the eddy currents induced in use in a coin under test by the short pulse, and to produce a first signal representative of the rate of decay of the eddy currents induced by the short pulse, and a second monitoring means adapted to monitor the decay of the eddy currents induced in use in the coin by the long pulse, and to produce a second signal representative of the rate of decay of eddy currents induced in the coin by the longer pulse, comparison means for comparing a set of said first and second signals with stored reference sets of said first and second signals obtained by subjecting minted coins to said first and second drive pulses in a calibration procedure, the first reference signal of each set of reference signals corresponding to eddy currents produced in a work-hardened surface skin of such minted coins, and the second reference signal of each set corresponding to eddy currents being produced within the body of the minted coins, the pulse length of said long pulse being chosen such that said second reference signals are substantially not dependent on the thickness of the minted coins of said pre-determined type/s.

Other objects, features and advantages of the present invention will become apparent upon reading and understanding this specification, taken in conjunction with the accompanying drawings.

The invention will now be further described, by way of example only, with reference to the accompanying drawings.

DETAILED DESCRIPTION OF EMBODIMENTS OF THE INVENTION

Figure 1:
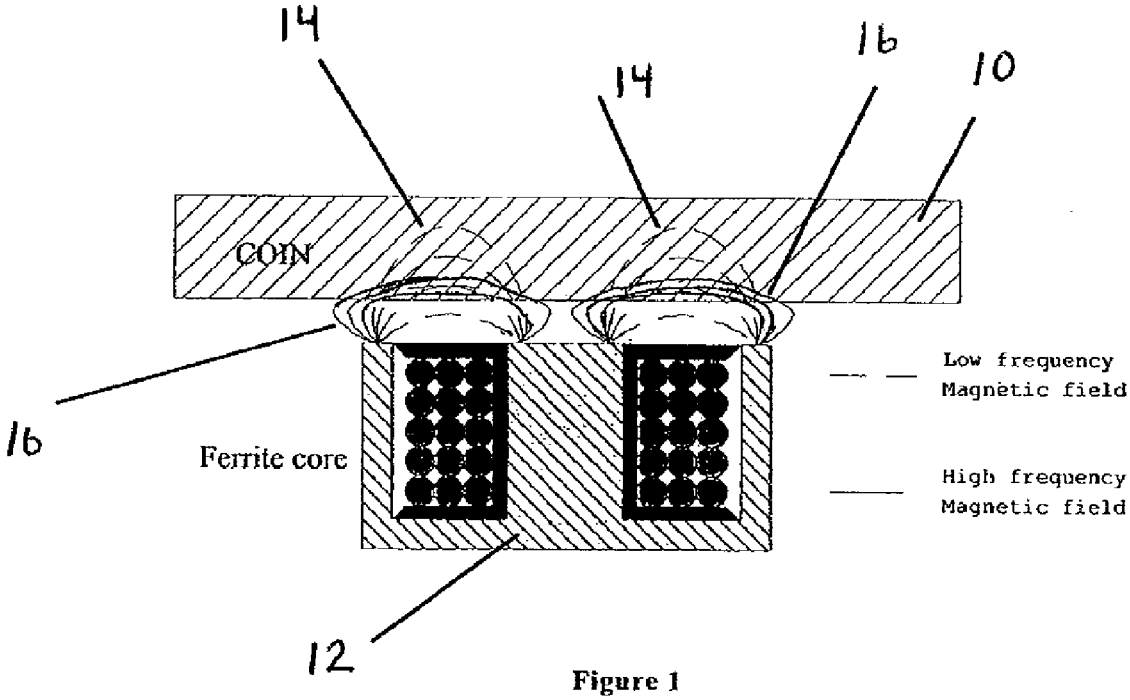
FIG. 1 shows how the magnetic fields produced by a typical coin discriminator coil are distorted by a coin.

In one embodiment a single coil 12, such as the coil 12 of FIG. 1, is driven at two frequencies (e.g. a low frequency and a high frequency). The low frequency is chosen to develop a low frequency magnetic field 14 that penetrates to a skin depth of just less than 1 mm, a depth that is less than the thickness of coins 10 under test. The high frequency is chosen to develop a high frequency magnetic field 16 that penetrates to a skin depth of about 0.1 mm. The presence of a coin 10 causes the apparent inductance and resistance of the coil 12 to change. These changes are measured at both frequencies. From these changes the conductivity of the coin can be calculated. The high frequency change gives the surface conductivity and the low frequency gives the bulk conductivity.

Figure 3:
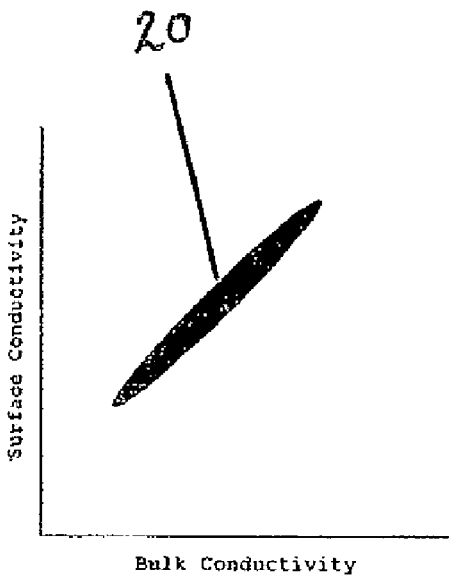
FIG. 3 shows the distribution of individual coin readings when plotted as surface verses bulk conductivity, FIG. 4 as FIG. 3, but comparing genuine minted coins with counterfeit cast ones.

If a large number of coins 10 are measured and the conductivities are plotted against each other a distribution 20 like the one shown in FIG. 3, is produced. The graph shows that coins 10 with a high surface conductivity also have a high bulk conductivity and vice versa. This is to be expected, as the conductivity differences between the coins 10 are caused by small variations in the batch alloy from which they are made.

Figure 4:
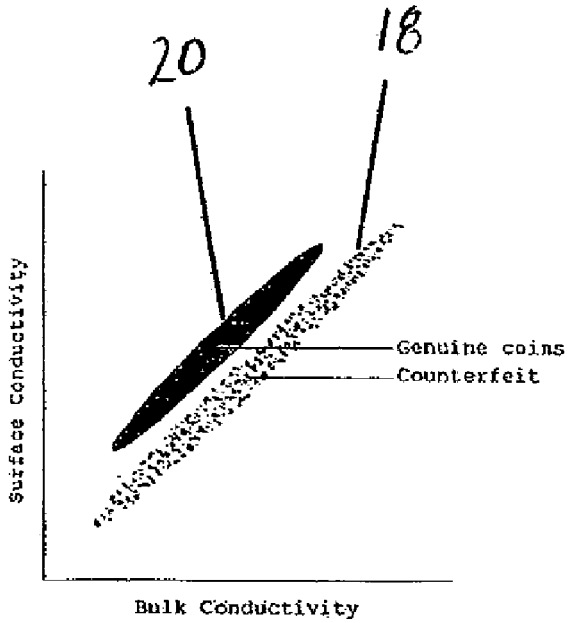

The use of a single small coil 12 in the centre of the coin 10 is advantageous. It is important that the eddy currents should be flowing in the same part of the coin 10 as edge effects alter the conductivity readings. The distribution shown in FIG. 4, indicates the difference between reference sets of data 18 for counterfeit coins and reference sets of data 20 for genuine coins. The reference sets of data 18 for counterfeit coins are shown as the "dotted" distribution. This is because the number of counterfeit coins is small compared to the number of genuine coins. In terms of either surface or bulk conductivity alone, the counterfeit coin data readings 18 overlap the data 20 of genuine coins and cannot be rejected. However when the surface and bulk conductivity are plotted as the reference sets of data 18, 20, the genuine coins show a higher surface conductivity for a given bulk conductivity due to the effects of work-hardening during the minting process.

Figure 2:
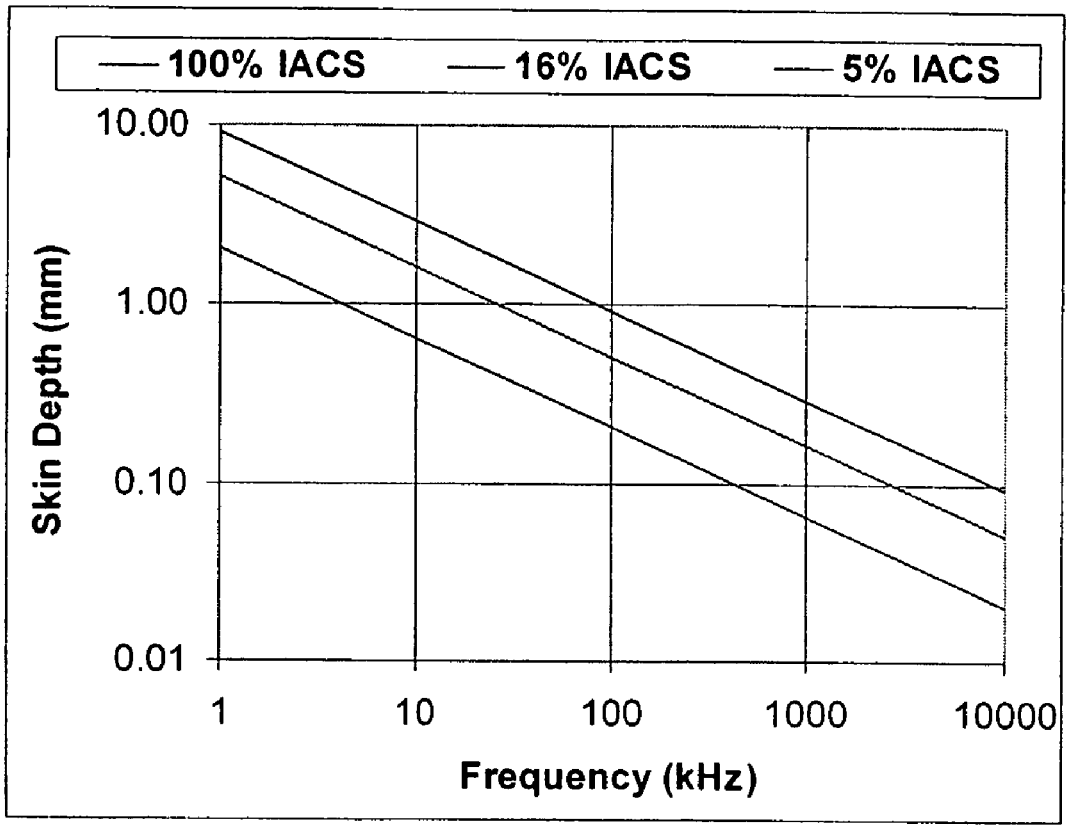
FIG. 2 is a graph showing the relationship between Frequency, conductivity and skin depth for non-magnetic materials.

The conductivity of a coin blank is known to be slightly different to that of a minted coin. The effect is described as "work-hardening of the surface causes the % IACS value to increase". A simplistic picture is the minting press squeezing the atoms closer together so they conduct better. The minting process makes the coin's surface conduct better. This effect can be used to distinguish a minted coin from a counterfeit coin made of exactly the same material. The assumption is that the counterfeit coin is cast and thus exhibits the same conductivity throughout. The exact value of conductivity varies from one coin to the next. This is thought to be due to impurities in each batch of metal because coins made from the same melt are significantly more repeatable than circulation coins. The surface conductivity change due to minting is smaller than the natural batch to batch variability. Thus we cannot tell a cast from a minted coin by surface conductivity alone. It is the ratio of surface to bulk conductivity that is the fingerprint of minting. As discussed, two types of electronic circuits can be used to measure surface and bulk conductivity. They are called the continuous wave, CW, method and the pulse induction, PI, method. The CW method is easier to explain, because it uses frequencies that can be related to skin depth and coin thickness using FIG. 2. Specifically, the CW method involves accurately measuring a small percentage change in the inductance and resistance of a coil 12.

The PI method measures a change from zero. Without a metal coin 10, the eddy current decay does not exist.

Figure 6:
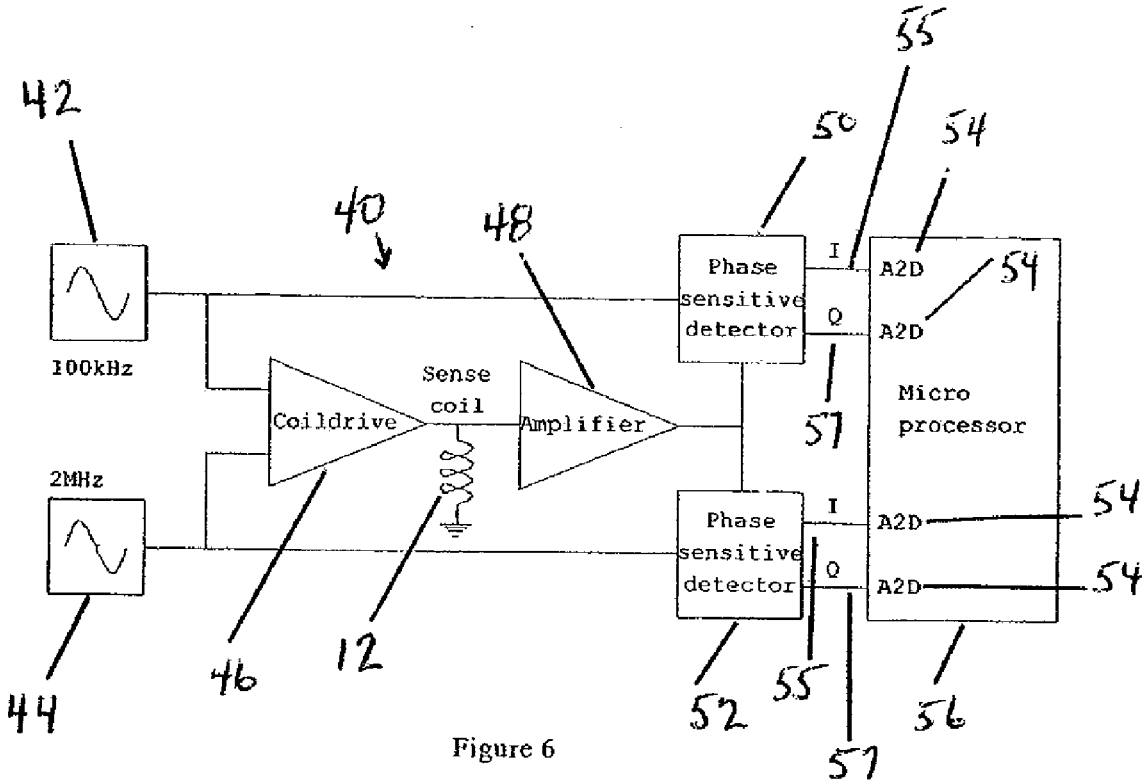
FIG. 6 shows a block diagram of the continuous wave (CW) embodiment of the invention.

FIG. 6 shows a block diagram 40 of the CW embodiment of the invention. It starts with two oscillators, a first oscillator 42 being operated at a frequency of 100 kHz and a second oscillator 44 being operated at a frequency of 2 MHz. These frequencies have been chosen from the graph shown in FIG. 2. The 100 kHz frequency of the first oscillator 42 has a skin depth of 0.5 mm in a 16% IACS coin 10. The 2 MHz frequency of the second oscillator 44 has a skin depth of 0.1 mm in the same coin. This difference in skin depth means the 100 kHz signal of the first oscillator 42 gives more information about the bulk conductivity, whereas the 2 MHz signal of the second oscillator 44 is giving more surface conductivity information.

These two frequencies are combined and used to drive the coil 12 via a current source 46. Coils, such as the coil 12, always contain an amount of stray capacitance, which gives them a self resonant frequency. This self-resonance must be significantly higher than the highest driving frequency. For this reason the coil 12 must be low capacitance and low inductance. The coin 10 causes an apparent change in the resistance of the coil 12. For this change to be significant, the coil 12 must also be low resistance. A single layer coil 12 wound with Litz wire gives the best characteristics.

The voltage across the coil 12 is amplified by an amplifier 48 and fed to a pair of phase sensitive detectors 50, 52. These detectors 50, 52 use reference signals from the two oscillators 42, 44 to turn the frequency components across the coil 12 into DC levels for each oscillator 55, 57. Two DC levels 55, 57 are produced for each oscillator 42, 44. The two DC levels 55, 57 measure the amount of signal in-phase and at right angles to the reference from the respective oscillator 42, 44. This is done for each oscillator 42, 44, giving four DC levels 55, 57 in total. These four levels change as the coin 10 rolls past the coil 12. The four levels 55, 57 are converted into numbers by the analog to digital converters, A2D 54, built into the microprocessor 56. This use of phase sensitive detectors 50, 52 is standard knowledge to someone skilled in the art.

Figure 5:
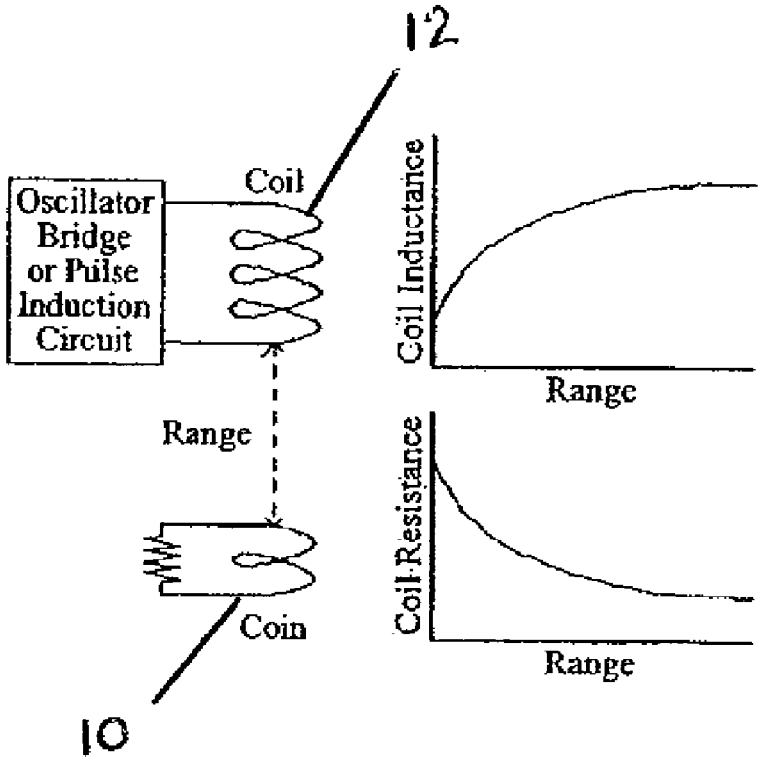
FIG. 5 shows how the apparent inductance and resistance of a coil change with range between the coil and coin.

The four measured voltages can be processed in software to determine when the coin is over the middle of the coil 12. The readings from the coin 10 in this position can be used to produce a ratio between the conductivity of the coin 10 at the 100 kHz frequency of the first oscillator 42 and the conductivity of the coin 10 at the 2 MHz frequency of the second oscillator 44. The mathematical formulas for this conversion are known to a person skilled in the art. The calculation includes a variable 'M' for the mutual inductance between the coin 10 and coil 12. This value is not known exactly as it is dependent on the range between the coin 10 and coil 12. FIG. 5 shows how the apparent inductance and resistance of the coil 12 changes with the range to the coin 10. The range to the coin 10 is never known exactly because it depends on the pattern on the face of the coin 10. By using the same coil 12 for both frequencies, the unknown 'M's cancel out to give a true ratio. This ratio can be compared to the known range of ratios based on the reference sets of data 20 for minted coins and used to reject counterfeit coins outside this range.

In a modification a third oscillator (not shown) can be employed, operating at a frequency intermediate those of the two oscillators 42, 44. The frequency can be chosen to induce eddy currents to a depth below that of the skin depth. This can provide improved characterisation of coins 10 under test. The three frequencies give rise to sets of three measurements for a coin 10 under test, that can be compared with sets of three measurements for minted coins 20 in a calibration procedure.

Figure 7:
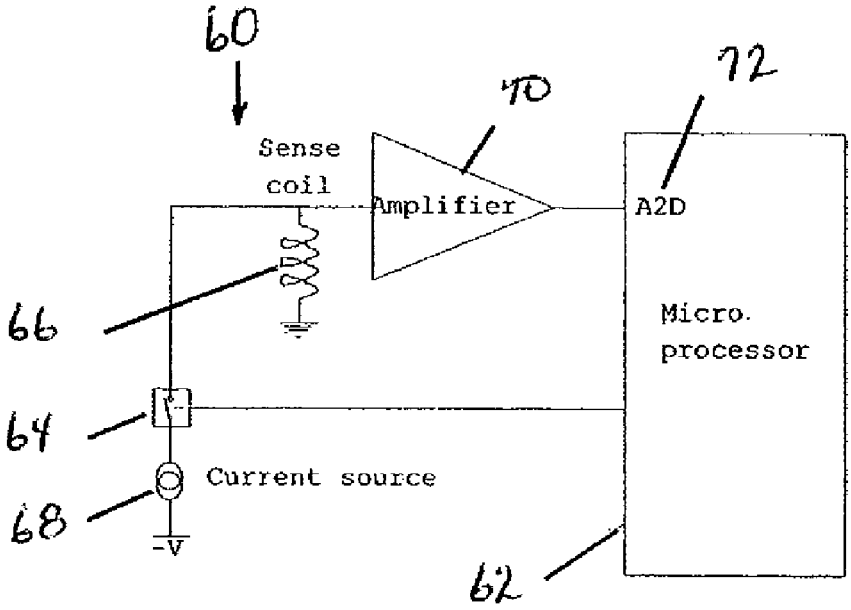
FIG. 7 shows a block diagram of the pulse induction (PI) embodiment of the invention.

FIG. 7 shows a PI embodiment 60 of the invention. The microprocessor 62 controls a transistor switch 64 that connects the coil 66 to a constant current source 68. Current levels around 1 Amp are typical. A current source 68 is used in preference to a voltage source because the resistance of the coil 66 changes with temperature. To produce data readings for the coin 10 that are independent of temperature, the magnetic field and hence the current must be stable.

The microprocessor 62 controls the time for which the switch 64 is closed. When the switch 64 is opened, the coil 66 produces a large back EMF. To prevent the voltage on the coil 66 from ringing, the input resistance of the amplifier 70 is chosen to critically damp the coil and its stray capacitance. In the absence of a coin 10, the back EMF decays very rapidly to zero. When a coin 10 is in front of the coil 66, the voltage returns to zero more slowly. The rate of decay is the same as the eddy currents within the coin 10. By measuring the decay rate, the conductivity of the coin 10 can be found.

The same skin depth effects also apply to the PI method. However instead of frequency, the factors are the time for which the switch 64 is closed and the delay to the measurement of decay rate. The switch-closed time 80 is called the drive pulse length (see FIG. 8). The time 82 between the end of the drive pulse and the measurement of the sample voltage is called the "delay to sample" (see FIG. 8). Making these times 80, 82 longer is the equivalent of using a lower frequency in the CW method.

The PI equivalent of the high frequency measurement is made by closing the switch 64 for just over 1 microsecond. After opening the switch 64 a delay of 1 microsecond is allowed for the back EMF to decay and then the voltage output from the amplifier 70 is measured by the A2D converter 72.

During the 1 microsecond the switch 64 is closed, the current through the coil 66 must build up to the constant current level. This current level, the time and the open circuit voltage of the current source 68 determine the coil 66 inductance that must be used. In one embodiment the current level is 1 Amp and the open circuit voltage is 10 Volts. This means the coil 66 inductance must be 10 microHenrys or smaller.

The PI equivalent of the low frequency, or bulk conductivity measurement, is made by closing the switch 64 for longer and waiting longer before reading the A2D converter 72.

Typical values for the switch closed time 80 are 100 to 200 microseconds. Typical values for the delay to sample time 82 are 50 to 100 microseconds. The exact values chosen for these times 80, 82 can be optimised for the conductivity and thickness of the coin 10, see below.

With the PI system, the low and high frequency measurements cannot be made at the same time. Desirably the high frequency measurement is made first. The low frequency drive pulse starts immediately after the high frequency measurement has been made. The coin 10 may move slightly during the low frequency drive pulse. This is a disadvantage of the PI method compared to the CW method.

Figure 8:
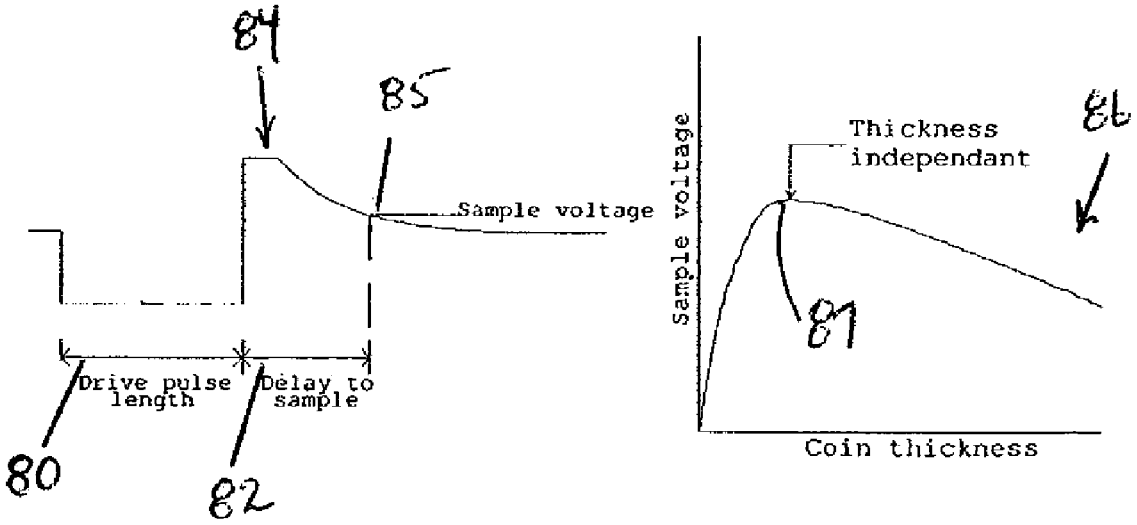
FIG. 8 shows some advantages of the pulse induction, PI, embodiment.

The advantage of the PI method is shown in FIG. 8. The trace 84 on the left shows the "low frequency" drive pulse and eddy current decay as seen at the output of the amplifier. The voltage measured at the sample point 85 will vary with coin 10 thickness. A graph 86 of how this voltage 85 varies with thickness is shown on the right. The graph contains a flat top, at the point 87 the voltage reading 85 is not affected by a small changes in coin 10 thickness. These small changes are caused by the pattern on the coin 10. To get consistent readings from a large number of coins 10 operating the system near the flat top produces a smaller spread on the coin 10 readings.

The position of the flat top depends on the Thickness and conductivity of the coin and on the length 80 of the drive pulse. This length 80 can be adjusted to match the type of coin 10 being measured. The ability to do this is one advantage of the PI method. A secondary advantage is That the electronics are simpler and thus cheaper to implement.

The PI and CW results are related by the Fourier transform. In theory this thickness independent conductivity reading could be calculated from CW amplitude and phase measurements. In practice, this can sometimes be difficult because of electrical noise and A2D convert limitations that prevent the measurements being made accurately enough.

The various embodiments disclosed herein are provided for the purpose of explanation and example only, and are not intended to limit the scope of the appended claims. Those of ordinary skill in the art will recognize That certain variations and modifications can be made to the described embodiments without departing from the scope of the invention.

The invention claimed is:

1. A method of distinguishing between minted coins of a predetermined type and bogus coins of a similar metal content, the method comprising subjecting at least one coil adjacent to a coin under test to both low and high frequency currents, monitoring an apparent change of impedance of the at least one coil resulting from eddy currents induced in the coin to produce first and second signals representative of changes of said impedance, the first signal corresponding to eddy currents produced in the coin by the high frequency current, and the second signal corresponding to eddy currents produced in the coin by the low frequency current, the frequency of said low frequency current being chosen such that said second signal is substantially not dependent on the thickness of the minted coins of said pre-determined type, performing a calibration procedure with minted coins to measure reference sets of data for the first and second signals for the minted coins, the reference sets of data being representative of a known range of data for minted coins, computing a ratio for the measured reference sets of data for the first and second signals for minted coins to define an acceptable parameter for minted coins, and comparing a ratio of said first and second signals for the coin under test with the computed ratio for the measured reference sets of data for the first and second signals for minted coins and determining whether the ratio for the coin under test fits within the determined acceptable parameter for minted coins.

2. The method claim of claim 1, wherein the at least one coil is used to carry both the low and high frequency currents, and the apparent change of impedance of said at least one coil is monitored to provide said first and second signals representative of changes in the impedance of said at least one coil, resulting respectively from said low and high frequency currents.

3. A method of distinguishing between minted coins of a predetermined type and bogus coins of a similar metal content, the method comprising subjecting at least one coil positioned adjacent to a coin under test to a low frequency current, subjecting said at least one coil positioned adjacent to the coin to a high frequency current, monitoring the eddy currents induced in the coin to produce first and second signals representative of the amplitude and phase of eddy currents induced respectively by said low and high frequency currents, the first signals corresponding to the amplitude and phase of eddy currents produced substantially in a work-hardened surface skin of such minted coins, and the second signals corresponding to the amplitude and phase of eddy currents being produced within the body of the minted coins, the frequency of said low frequency current being chosen such that said second reference signals are substantially not dependent on the thickness of the minted coins of said pre-determined types, performing a calibration procedure with minted coins to measure reference sets of data for the first and second signals for the minted coins, the reference sets of data being distinct from expected data of bogus coins and being representative of a known range of data for minted coins, computing a ratio for the measured reference sets of data for the first and second signals for minted coins to define an acceptable parameter for minted coins, and comparing a ratio of said first and second signals for the coin under test with the computed ratio for the measured reference sets of data for the first and second signals for minted coins and determining whether the ratio for the coin under test fits within the determined acceptable parameter for minted coins.

4. A coin discriminator for discriminating between minted coins of a predetermined type and bonus coins of a similar metal content and simulating said type, the coin discriminator comprising a coin path for receiving a coin under test, at least one coil positioned adjacent to said coin path, a first coil energisation means for subjecting said at least one coil to a first, low frequency current, a second coil energisation means for subjecting said at least one coil, to a second, high frequency current, a first monitoring means for monitoring a first apparent change of impedance of said at least one coil resulting from eddy currents induced in use within the body of said coin by said first current, and for producing a first signal representative of said first change of impedance, the frequency of the low frequency current being chosen such that the first signal is substantially not dependent on the thickness of the minted coins of the predetermined type, a second monitoring means for monitoring a second apparent change of impedance of said at least one coil resulting from eddy currents induced in use in a work-hardened surface skin of said coin by said second current, and for producing a second signal representative of said second change of impedance, and a comparison means configured to compare a ratio of said first and second signals produced by a coin under test with a ratio for stored data for said first and second signals for minted coins, the data having been determined in a calibration procedure by subjecting minted coins of said type to said low and high frequencies, the data for minted coins being representative of a known range of data for minted coins, and the calibration procedure including computing a ratio for measured data for the first and second signals for minted coins to define acceptable parameters for minted coins.

5. The coin discriminator as claimed in claim 4 wherein said first and second coil energisation means are connected to the same coil.

6. A method of distinguishing between minted coins of a predetermined type or types and bogus coins of a similar metal content, comprising subjecting at least one coil adjacent to a coin under test to both short and long drive pulses, monitoring a decay of eddy currents induced in the coin by the pulsing of the at least one coil to produce first and second signals representative respectively of the rate of decay of the eddy currents produced by said short and long pulses, the first signal corresponding to eddy currents produced in a work-hardened surface skin of such minted coins, and the second signal corresponding to eddy currents being produced within the body of the minted coins, the pulse length of said long pulse being chosen such that said second signals are substantially not dependent on the thickness of the minted coins of said pre-determined type, performing a calibration procedure with minted coins to measure reference sets of data for the first and second signals for the minted coins, the reference sets of data being representative of a known range of data for minted coins, computing a ratio for the measured reference sets of data for the first and second signals for minted coins to define an acceptable parameter for minted coins, and comparing a ratio of said first and second signals for the coin under test with the computed ratio for the measured reference sets of data for the first and second signals for minted coins and determining whether the ratio for the coin under test fits within acceptable parameters for minted coins.

7. The method claim of claim 6 in which a single coil is used to respectively carry both the short and the long pulses, and the decays of the resulting eddy currents in the coin.

8. A coin discriminator for discriminating between minted coins of a predetermined type and bogus coins of similar metal content and simulating said type, the coin discriminator comprising a coin path for receiving a coin under test, at least one coil positioned adjacent to said coin path, a first coil pulse drive means for subjecting said at least one coil to a first drive pulse of short duration, a second coil pulse drive means for subjecting said at least one coil to a second drive pulse of longer duration, a first monitoring means adapted to monitor a decay of the eddy currents induced in the coin under test by the first drive pulse, and to produce a first signal representative of the rate of decay of the eddy currents induced by the first drive pulse, a second monitoring means adapted to monitor the decay of the eddy currents induced in the coin under test by the second drive pulse, and to produce a second signal representative of the rate of decay of eddy currents induced in the coin by the second drive pulse, a comparison means for comparing a ratio of said first and second signals produced by the coin under test with a ratio for stored data for said first and second signals for minted coins, the stored data having been determined in a calibration procedure subjecting minted coins of said type to said first and second drive pulses, the data for minted coins being representative of a known range of data for minted coins, and the calibration procedure including computing the ratio for stored data for minted coins to define acceptable parameters for minted coins, the first signal corresponds to eddy currents produced in a work-hardened surface skin of such minted coins, and the second signal corresponds to eddy currents being produced within the body of the minted coins, the pulse length of said long pulse being chosen such that said second signals are not dependent on the thickness of the minted coins of said pre-determined type.

* * * * *